US010307890B2

(12) United States Patent
Telischak, Jr. et al.

(10) Patent No.: US 10,307,890 B2
(45) Date of Patent: Jun. 4, 2019

(54) ABRASIVE ARTICLE AND METHOD OF MAKING THE SAME

(71) Applicant: 3M INNOVATIVE PROPERTIES COMPANY, St. Paul, MN (US)

(72) Inventors: John Telischak, Jr., Apple Valley, MN (US); Wesley A. Raider, Lengby, MN (US); Daryl D. Johnson, Lake Elmo, MN (US); Edward L. Manor, Lakeland, MN (US); Paul D. Streeter, Shoreview, MN (US); Dean S. Holmes, Ellsworth, WI (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 0 days.

(21) Appl. No.: 15/834,946

(22) Filed: Dec. 7, 2017

(65) Prior Publication Data

US 2018/0093364 A1 Apr. 5, 2018

Related U.S. Application Data

(63) Continuation of application No. 14/280,762, filed on May 19, 2014, now Pat. No. 9,839,993, which is a continuation of application No. 12/279,896, filed as application No. PCT/US2007/062978 on Feb. 28, 2007, now Pat. No. 8,764,517.

(60) Provisional application No. 60/777,429, filed on Feb. 28, 2006.

(51) Int. Cl.

| | |
|---|---|
| ***B24B 23/02*** | (2006.01) |
| ***B24D 13/14*** | (2006.01) |
| ***B24B 45/00*** | (2006.01) |
| ***B24D 7/16*** | (2006.01) |
| ***B24D 13/20*** | (2006.01) |

(52) U.S. Cl.

CPC ..... *B24D 13/142* (2013.01); *B24B 23/02* (2013.01); *B24B 45/00* (2013.01); *B24B 45/006* (2013.01); *B24D 7/16* (2013.01); *B24D 13/20* (2013.01); *Y10T 29/49826* (2015.01)

(58) Field of Classification Search

CPC ..... B24B 23/02
USPC ..... 451/508, 509, 359, 490
See application file for complete search history.

(56) References Cited

U.S. PATENT DOCUMENTS

| | | | |
|---|---|---|---|
| 3,562,968 | A | 2/1971 | Johnson |
| 4,227,350 | A | 10/1980 | Fitzer |
| 4,507,897 | A | 4/1985 | Vieau |
| 5,679,067 | A | 10/1997 | Johnson |
| 5,931,729 | A | 8/1999 | Penttila |
| 5,951,389 | A | 9/1999 | Hettes |
| 6,261,156 | B1 | 7/2001 | Johnson |
| 6,371,837 | B1 | 4/2002 | Luedeke |

(Continued)

*Primary Examiner* — Robert Rose

(57) ABSTRACT

An abrasive article and method of making same wherein the abrasive article comprises a mounting assembly and an abrasive attachment assembly wherein the first interlock member of the mounting assembly and the second interlock member of the abrasive attachment assembly are configured to align the central axis of the abrasive attachment assembly and the central axis of the mounting assembly, and the first interlock member releasably engages the second interlock member. The abrasive article is adapted to clean a work surface area around studs using a rotary tool, including, for example, a drills or die grinder.

6 Claims, 3 Drawing Sheets

(56) References Cited

U.S. PATENT DOCUMENTS

| | | | | |
|---|---|---|---|---|
| 6,609,951 | B1 * | 8/2003 | Bates | B23B 31/11 264/153 |
| 2002/0081952 | A1 * | 6/2002 | Fritz | B24B 45/00 451/56 |
| 2003/0114078 | A1 * | 6/2003 | Mann | B08B 1/04 451/28 |
| 2003/0114096 | A1 | 6/2003 | Fritz | |
| 2009/0104862 | A1 | 4/2009 | MacKay | |

* cited by examiner

ABRASIVE ARTICLE AND METHOD OF MAKING THE SAME

CROSS REFERENCE TO RELATED APPLICATIONS

This application is a continuation patent application of U.S. patent application Ser. No. 14/280,762, filed May 19, 2014, allowed, which is a continuation patent application of U.S. patent application Ser. No. 12/279,896, filed Mar. 2, 2010, now issued as U.S. Pat. No. 6,764,517, issued on Jul. 1, 2014, which is a national stage filing under 35 U.S.C. 371 of PCT/US2007/062978, filed Feb. 28, 2007, which claims priority to Provisional Application No. 60/777,429, filed Feb. 28, 2006, the disclosure of which is incorporated by reference in its/their entirety herein.

FIELD OF INVENTION

The present invention relates generally to an abrasive article and methods of making the same. More particularly, the present invention relates to an abrasive article adapted to clean work surface areas around studs using rotary tools, including, for example, drills and die grinders.

BACKGROUND

During the replacement of brake rotors on an automobile, the wheel hub surface should be cleaned to remove rust and debris. This is necessary to ensure correct seating of the rotor and wheel onto the automobile. Failure to properly clean the wheel hub can result in poor brake rotor alignment, which can lead to performance issues such as pulsation and uneven brake pad wear. One method of cleaning the wheel hub surface is use of abrasive articles on power tools, such as die grinders. A problem with the use of power tools is the distance between the studs (lugs) and the center bore area of the wheel hub is smaller than the outer diameter of the backup pad typically mounted on the tool. The artisan must change to a smaller diameter backup pad and abrasive on the tool or clean with hand-held abrasives. Neither of these options is desirable or typically pursued.

There are commercially available tools sold as "Wheel Hub Refinishing Kits". An example is product number AST7896 available from Stempf Automotive Industries manufactured by Astro Pneumatic Tool Company. This product consists of a hollow mandrel about 2.5 inches long with a shank on one end to fit into a drill chuck. The opposite side of the holder is a ring of hook fastener material. The kit comes with donut-shaped nonwoven abrasives with a loop material bonded on one side to attach to the hooks on the holder. In operation, the holder and abrasive are aligned such that the stud is positioned below the tool opening and the holder is lowered until the abrasive contacts the work surface. While these products have been available for several years, they have performance limitations. For example, the system is not designed for use on the high-speed die grinders found in the typical automotive shop because at high speeds, the nonwoven abrasive consumable is jettisoned from the holder. When the system is used on a lower speed drill, the hooks are prone to being sheared off due to the artisan's tendency to use excessive pressure in an attempt to increase the speed of the cleaning operation. A further disadvantage is that the coaxial alignment of the abrasive material with the tool is subject to operator positioning errors that can lead to "wobble" and ultimately, disengagement of the abrasive material from the tool.

There is a continuing need for improved abrasive articles for cleaning areas around studs, including abrasive articles that work effectively with high-speed rotary power tools.

SUMMARY

The present invention relates generally to an abrasive article and methods of making and using the same. More particularly, the present invention relates to an abrasive article adapted to clean work surfaces areas around studs using rotary tools, including, for example, drills and die grinders.

In one aspect, the present invention provides an abrasive article comprising a mounting assembly and an abrasive attachment assembly. The mounting assembly comprises an elongated body having a first end having a shaft for attachment to a rotary tool, a second end having an aperture, at least one sidewall extending between the first end and the second end, an elongated cavity extending from the aperture toward the first end having a central axis, and a first interlock member proximate the second end. The abrasive attachment assembly comprising an abrasive layer attachment interface having a second interlock member, an abrasive layer affixed to the abrasive layer attachment interface, and a channel that extends through the second interlock member and the abrasive layer, the abrasive attachment assembly having a central axis. The first interlock member and the second interlock member are configured to align the central axis of the abrasive attachment assembly and the central axis of the mounting assembly, and the first interlock member releasably engages the second interlock member.

In some embodiments, the elongated body of the mounting assembly comprises an injection molded polymeric material. In some embodiments, at least one of the first and second interlock members comprise a thread, a screw interface with multiple lead threads, a snap interface, or a torque transfer member.

In some embodiments, the abrasive layer comprises a nonwoven abrasive, including, for example, a lofty web of continuous three-dimensionally undulated inter-engaged autogenously bonded filaments. In other embodiments, the abrasive layer comprises a coated abrasive or a brush. In some embodiments, the abrasive layer is attached to the abrasive layer attachment interface with adhesive or a weld, such as, for example, a weld formed by spin-welding or friction-welding.

In another aspect, the present invention provides an abrasive attachment assembly that attaches to a mounting assembly having a central axis. The abrasive attachment assembly comprises an abrasive layer attachment interface having an interlock member, an abrasive layer affixed to the abrasive layer attachment interface, and a channel that extends through the interlock member and the abrasive layer. The abrasive attachment assembly has a central axis. The interlock member is configured to releasably connect the abrasive attachment assembly to the mounting assembly and align the central axis of the abrasive attachment assembly and the central axis of the mounting assembly.

In another aspect, the present invention provides methods for manufacturing abrasive articles. In one aspect, a method of the present invention includes making an abrasive article that attaches to a mounting assembly having a central axis and first interlock member by providing an abrasive attachment interface affixed to a second interlock member, and attaching an abrasive layer to the abrasive attachment interface to form an abrasive attachment assembly. The abrasive attachment assembly has a channel extending through it. In some embodiments, the abrasive attachment assembly is attached to a mounting assembly.

The above summary of the present invention is not intended to describe each disclosed embodiment of every implementation of the present invention. The Figures and the detailed description that follow more particularly exemplify illustrative embodiments. The recitation of numerical ranges by endpoints includes all numbers subsumed with that range (e.g., 1 to 5 includes 1, 1.5, 2, 2.75, 3, 4, 4.80, and 5).

DETAILED DESCRIPTION

Figure 1:
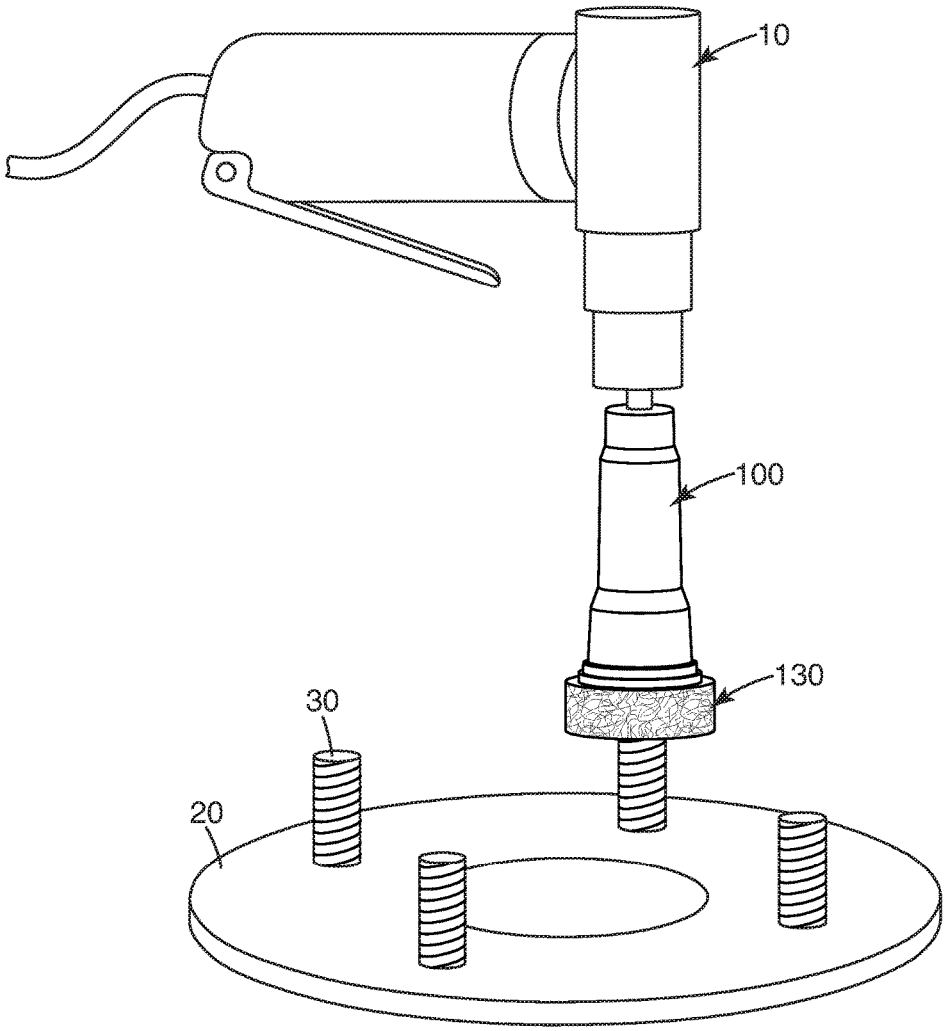
FIG. 1 is a perspective view of the abrasive article of the present invention being used to clean the area of a wheel hub proximate a threaded stud.

FIG. 1 shows a perspective view of an exemplary abrasive article of the present invention being used to clean the area of a wheel hub 20 proximate a threaded stud 30. As shown in FIG. 1, a mounting assembly 100 is mounted to a rotary tool 10. An abrasive attachment assembly 130 is releasably attached to the mounting assembly 100. The abrasive article (i.e., the combination of mounting assembly 100 and abrasive attachment assembly 130) comprises an elongated central cavity that allows a protrusion, such as threaded stud 30, to enter the abrasive article such that the abrasive layer can contact the area of the work surface, such as wheel hub 20, surrounding the protrusion.

Figure 2:
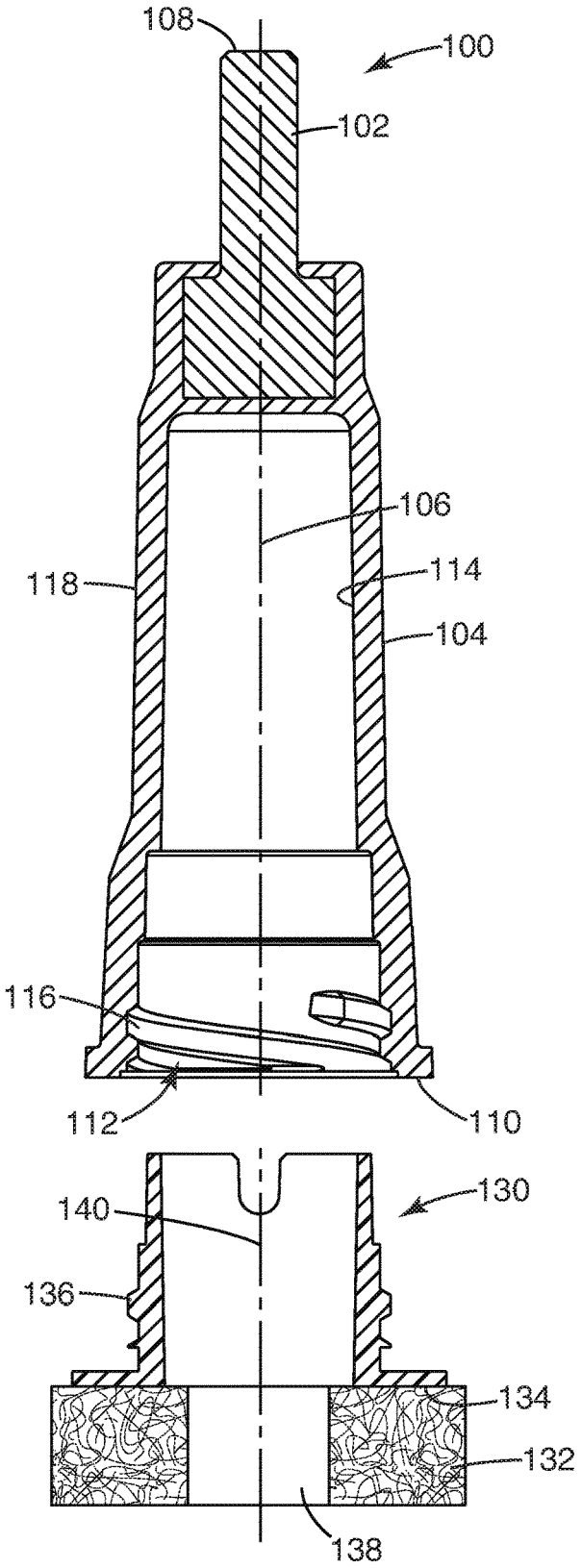
FIG. 2 is a cross-section view of the abrasive article shown in FIG. 1, wherein the abrasive attachment assembly has been disengaged from the mounting assembly.

FIG. 2 is a cross-section view of the abrasive article shown in FIG. 1, wherein the abrasive attachment assembly has been disengaged from the mounting assembly. As shown in FIG. 2, the abrasive article includes a mounting assembly 100 and an abrasive attachment assembly 130. Mounting assembly 100, having a first end 108 and a second end 110, includes shaft 102 for coupling to a rotary power tool. Shaft 102 is attached to elongated body 104. Elongated body 104 extends from shaft 102 at first end 108 to second end 110. Aperture 112 is centrally disposed at second end 110 and communicates with elongated cavity 114 bounded by sidewall 118. First interlock member 116 is proximate aperture 112.

Abrasive attachment assembly 130 includes abrasive layer 132 that is secured to second interlock member 136 by abrasive layer attachment interface 134. Channel 138 extends through abrasive layer 132, abrasive layer attachment interface 134, and second interlock member 136.

Mounting assembly 100 may be fabricated by any of a number of processes, including molding and machining. It may be monolithic or may be assembled from its several parts.

Shaft 102 may be of any appropriate composition and configuration to readily accommodate a driving means. Shaft 102 may be integrally formed with elongated body 104, (e.g., shaft 102 may be integrally molded with elongated body 104). Shaft 102 may be metallic, polymeric, ceramic, composite, or any other material known to those skilled in the art of abrasive article mounting assemblies for rotary tools. Shaft 102 may be of circular or non-circular cross-section. Shaft 102 may be adapted to couple with a male or female driving means. Shaft 102 may be of any length.

In some embodiments, shaft 102 does not extend from elongated body 104, but instead, is an opening in elongated body 104 (e.g. an internally threaded cylindrical cavity). In another embodiment, shaft 102 is a circular metal shaft that is incorporated into elongated body 104 via insert molding.

The elongated body is typically cylindrical, but can have any cross-sectional shape, and may be fabricated from metal, polymer, ceramic, composite or any other material known to those skilled in the art of abrasive article mounting assemblies for rotary tools using any techniques known to those skilled in the art. In one embodiment, elongated body 104 is fabricated from polymeric or reinforced polymeric materials by molding. In another embodiment, elongated body 104 is fabricated from reinforced polyamide by injection molding. In some embodiments, the elongated body 104, or at least a portion thereof, is machined.

First and second interlock members 116,136, respectively, are configured to cooperate to couple mounting assembly 100 to abrasive attachment assembly 130. First and second interlock members 116,136 are annular in configuration to allow communication between channel 138 and elongated cavity 114. In one embodiment, the first and second interlock members 116,136 are adapted to couple via a threaded interface. In one embodiment such as the embodiment shown in FIG. 2, first and second interlock members 116,136 are adapted to couple via a threaded interface with multiple lead threads.

Abrasive layer 132 is the working interface between the wheel hub cleaning tool and the workpiece to be cleaned. Abrasive layer 132 is annular in configuration and typically comprises abrasive particles adhered to a substrate with a binder. In some embodiments, abrasive layer 132 comprises a nonwoven abrasive. In some embodiments, abrasive layer 132 comprises a lofty web of continuous three-dimensionally undulated inter-engaged autogenously bonded filaments, such as, for example, the abrasive materials reported by U.S. Pat. No. 4,227,350 (Fitzer), incorporated herein by reference. In some embodiments, abrasive layer 132 comprises a coated abrasive. In some embodiments, abrasive layer 132 comprises an abrasive bristle material, including injection molded bristles as reported by U.S. Pat. No. 5,679,067 (Johnson, et al.), incorporated herein by reference. In yet other embodiments, abrasive layer 132 may be other surface conditioning materials that are free of abrasive particles and known to those skilled in the art.

Abrasive layer attachment interface 134 provides a securing means between second interlock member 136 and abrasive layer 132. As in the other components of abrasive attachment assembly 130, abrasive layer attachment interface 134 is annular in configuration and may be integral with second interlock member 136. In some embodiments, abrasive layer attachment interface 134 comprises an adhesive. In some embodiments, abrasive layer attachment interface 134 comprises a friction- or spin-weld interface, known to those skilled in the art, and reported, for example, by U.S. Pat. No. 5,931,729 (Penttila et al.) which can be made with or without the scrim layer present, and incorporated herein by reference.

In operation, abrasive attachment assembly 130 is secured to mounting assembly 100 by first and second interlock members 116, 136 thereby aligning central axis 140 of abrasive attachment assembly 130 with central axis 106 of mounting assembly 100. While alignment of central axis of abrasive attachment assembly 140 with central axis of mounting assembly 106 is not required to be absolute (i.e., coaxial), such alignment should be sufficiently close to coaxial to prevent undesirable eccentric forces between the abrasive attachment assembly 130 and mounting assembly 100. In some embodiments, the alignment between the centerline of the abrasive attachment assembly and the centerline of the mounting assembly is such that the centerlines are less than 2 millimeter apart, as measured at the plane of the abrasive layer contact surface (in some embodiments, less than 1, or even less than 0.5 millimeters apart).

Shaft 102 is secured to a rotary power tool (not shown). The assembled wheel hub cleaning tool is placed over a protrusion (e.g., a wheel lug) that is accommodated by channel 138 and elongated cavity 114 and is urged against the surface of the brake hub. The rotary power tool is activated, thereby cleaning the surface of the wheel hub adjacent the protrusion. Alternatively, the rotary power tool may be activated prior to positioning the wheel hub cleaning tool over the protrusion.

Figure 3:
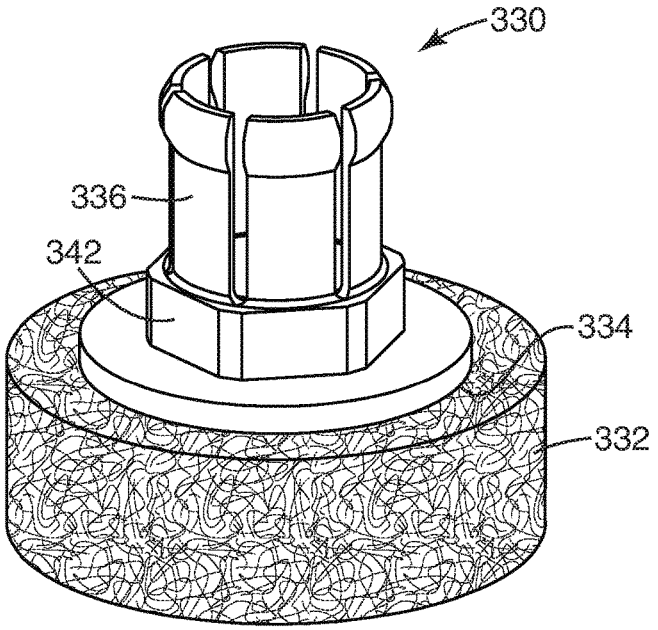
FIG. 3 is a perspective view of an exemplary abrasive attachment assembly of the present invention.

In another embodiment, the first and second interlock members are adapted to couple via a rounded snap interface, such as shown, for example in FIG. 3. FIG. 3 is a perspective view of an exemplary abrasive attachment assembly of the present invention. As shown in FIG. 3, the abrasive attachment assembly 330 comprises an abrasive layer 332 affixed to an abrasive layer attachment interface 334. A second interlock member 336 having an arcuate surface is used to releasably attach the abrasive attachment assembly 330 to a mounting assembly having a first interlock member configured to releasably engage with the second interlock member 336. The abrasive attachment assembly 330 also includes an optional torque transfer member 342 that is independent of the second interlock member 336. The torque transfer member is configured to allow positive torque transfer from the mounting assembly, configured with a matching socket for the torque transfer member, to the abrasive attachment assembly 330. The design and configuration of the torque transfer member can be any geometric shape that creates a positive interlock, including for example, squares, polygons, stars, ovals, and the like.

Figure 4:
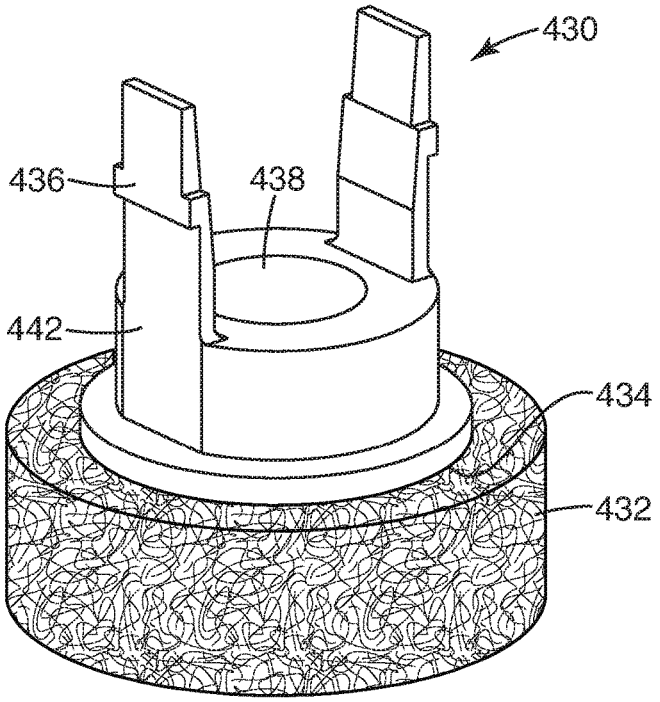
FIG. 4 is a perspective view of an exemplary abrasive attachment assembly of the present invention.

In another embodiment, the first and second interlock members are adapted to couple via a snap interface, such as shown, for example in FIG. 4. FIG. 4 is a perspective view of an exemplary abrasive attachment assembly of the present invention. As shown in FIG. 4, the abrasive attachment assembly 430 comprises an abrasive layer 432 affixed to an abrasive layer attachment interface 434. A second interlock member 436 having a step is used to releasably attach the abrasive attachment assembly 430 to a mounting assembly having a first interlock member configured to releasably engage with the second interlock member 436. The second interlock member 436 includes a torque transfer member 442. The torque transfer member 442 comprises a flat surface configured to allow positive torque transfer from the mounting assembly to the abrasive attachment assembly 430.

The abrasive attachment assembly of the present invention can be designed to allow the quick and simple replacement of the abrasive attachment assembly after the abrasive layer has expired. In addition, the interlock of the abrasive attachment assembly and the interlock of the abrasive attachment assembly of the present invention can be configured to align the channel of the of the abrasive attachment assembly with the elongated cavity of the mounting assembly.

Advantages and other embodiments of this invention are further illustrated by the following examples, but the particular materials and amounts thereof recited in these examples, as well as other conditions and details, should not be construed to unduly limit this invention. For example, the abrasive layer can comprise alternate materials and the first and second interlock members can comprise various geometries.

EXAMPLES

Example 1 and Comparative Example A

Inventive Example 1 and Comparative Example A were evaluated to demonstrate the improvement in the interlock between the mounting assembly and the abrasive attachment assembly. The mounting assembly was configured similarly to the mounting assembly shown in FIG. 2 having a threaded first interlock member.

Example 1

The abrasive attachment assembly of Example 1 was a 3.8 cm diameter×1.4 cm center hole (1½ in diameter×9/16 in center hole) disc of "Clean and Strip XT" web (3M Company, St. Paul, Minn.) that was spin-welded to an interlock member having threads to form an abrasive attachment assembly similar to the abrasive attachment assembly shown in FIG. 2.

Comparative Example A

The abrasive attachment assembly of Comparative Example A was a 3.2 cm diameter×1.4 cm center hole (1¼ in diameter×9/16 in center hole) disc of "Velcro HTH805" hook fastener material (Velcro USA, Manchester, N.H.) that was glued to the same type of interlock member as Example 1 with "3M DP190" epoxy adhesive (3M Company, St. Paul, Minn.). 3.8 cm diameter×1.4 cm center hole (1½ in diameter×9/16 in center hole) discs of "Coating Removal Disc" ("CRD") material (3M Company, St. Paul, Minn.) were die-cut from available 7-in diameter Coating Removal Discs. Coating Removal Discs are "Clean and Strip" (3M Company, St. Paul, Minn.) abrasive web with a loop material of brushed nylon fabric glued to the web with hot melt adhesive.

For testing, the mounting assembly (without abrasive attachment assembly) was attached to a series of tools having a range of rated speeds. Each tool was then free-spun at full-throttle and speed was measured with a non-contact tachometer. The abrasive attachment assembly of Comparative Example A was attached to the mounting assembly. The concentricity of disc to hook attachment was determined by visual inspection. The tool was run at maximum speed for at least 15 seconds. The effect of rotation on the position of the abrasive attachment was then inspected. The abrasive attachment assembly was then replaced with that of Example 1. The tool was then run at maximum speed for at least 15 seconds and abrasive attachment inspected. Test results are summarized in Table 1.

TABLE 1

| Tool | Free Spin Speed | Comparative Example A | Example 1 |
|---|---|---|---|
| Dynabrade straight shaft Part No. 51059 (Dynabrade, Clarence, NY) | 2600 rpm | No effect | No effect |
| Ingersoll Rand Cyclone CA 120 right angle die grinder (Ingersoll-Rand Company Ltd., Hamilton, Bermuda) | 8500 rpm | Disc remained on mounting assembly, but moved off-center | No effect |
| Ingersoll Rand Cyclone TD180 right angle die grinder | 12400 rpm | Disc remained on mounting assembly, but moved off-center | No effect |
| St. Louis Pneumatic Model SLP 83150 right angle die grinder (St. Louis Pneumatic, Fenton, MO) | 18500 rpm | Disc immediately detached from mounting assembly at hook and loop interface | No effect |

Example 2 and Comparative Example B

Abrasive articles of Example 2 and Comparative Example B were tested to compare their cleaning efficacy when applied to wheel hub surfaces.

Example 2

Example 2 was an abrasive article consisting of a mounting assembly and an abrasive attachment assembly prepared similarly to that of Example 1, except that the interlock members of the mounting assembly and the abrasive attachment assembly did not comprise threads. Rather, the interlocks comprised a snap interface having a single snap member (FIG. 4 shows a similarly configured snap interface having two snap members).

Comparative Example B

Comparative Example B was a "Wheel Hub Resurfacing Kit", Part No. 7896, obtained from Astro Pneumatic Tool Company, City of Industry, Calif.

Example 2 and Comparative Example B were tested by simulating actual end use of the abrasive articles. Wheel hubs with various levels of corrosion were purchased from a used auto parts facility. The hubs were marked with a paint-marking pen to divide the wheel hub-brake rotor mating surface into two equivalent sections. One half of the wheel hub surface was abraded with Comparative Example B until the surface was clean or it was evident that no further removal of corrosion products was taking place. In accordance with the manufacturer's instructions on the packaging, Comparative Example B was run on a power drill; the drill used for testing was an electric drill with a rated maximum speed of 1200 rpm. The hub surface was considered clean when all foreign materials, such as grease, were removed from the surface and all corrosion products extending above the height of the original equipment manufacturer's machining marks were removed. Areas of the wheel hub surface that were not clean were colored with a black permanent marker.

Example 2 was then used to abrade the other half of the wheel hub surface. Example 2 was run on a pneumatic right angle die grinder with a rated speed of 12,000 rpm. The surface was abraded until the surface was clean or it was evident that no further removal of corrosion products was taking place. Areas of the wheel hub surface that were not clean were colored with a black permanent marker.

Digital images were then taken of the wheel hub from a perspective normal to the plane of the wheel hub-brake rotor mating surface. An image analysis software package was used to conduct the following operations: The color digital image was converted to an 8-bit grey scale image; and, portions of the image that were not part of the wheel hub-brake rotor mating surface (such as the wheel hub studs, center bore, and background outside the outer diameter of the wheel hub) were set to grey scale level 256.

The "region of interest" is an area in a digital image which is defined and from which all measurements are made. A region of interest was designated on the wheel hub image to include only the wheel hub surface which was cleaned with Comparative Example B. The image pixels in the region of interest corresponding to areas marked with the permanent marker were counted and the count is referred to as the "number of unclean pixels". The image pixels with grey scale less than 256 in the region of interest were then counted. This corresponds to all pixels of the wheel hub-brake rotor mating surface and is referred to a "total number of pixels". The percentage of area cleaned by the Wheel Hub Resurfacing Kit was then calculated by the formula:

$$\%\ \text{Area Cleaned} = 100 * \left(1 - \frac{\text{number of unclean pixels}}{\text{total number of pixels}}\right)$$

A region of interest was then designated to include only the wheel hub-brake rotor mating surface that was cleaned with Example 2 and the same analysis performed to arrive at the percentage of area cleaned by the invention. Results are shown in Table 2.

TABLE 2

| Wheel Hub Number | Wheel Hub's Car Model and Year of Manufacture | Abrasive Article Used | Number of Unclean Pixels | Total Number of Pixels | % Area Cleaned |
|---|---|---|---|---|---|
| 1 | 98 Taurus | Comparative Example B | 43451 | 130149 | 66.6 |
| 1 | 98 Taurus | Example 2 | 12375 | 126180 | 90.2 |
| 2 | 93 Cavalier | Comparative Example B | 39762 | 117477 | 66.2 |
| 2 | 93 Cavalier | Example 2 | 5713 | 115546 | 95.1 |
| 3 | 95 Neon | Comparative Example B | 75404 | 140851 | 46.5 |
| 3 | 95 Neon | Example 2 | 19808 | 160077 | 87.6 |

It is to be understood that even in the numerous characteristics and advantages of the present invention set forth in above description and examples, together with details of the structure and function of the invention, the disclosure is illustrative only. Changes can be made to detail, especially in matters of shape, size and arrangement of the first and second interlock members and methods of use within the principles of the invention to the full extent indicated by the meaning of the terms in which the appended claims are expressed and the equivalents of those structures and methods.

What is claimed is:

1. An abrasive attachment assembly comprising:

an abrasive layer attachment interface;

an interlock member comprising a threaded portion proximate the abrasive layer attachment interface and a non-threaded portion extending from the threaded portion; and an abrasive layer affixed to the abrasive layer attachment interface opposite the interlock member;

wherein the abrasive layer comprises a nonwoven abrasive material, and further wherein the abrasive layer attachment interface comprises a friction-weld;

a channel extending along a central axis through the abrasive layer, the abrasive layer attachment interface, and the interlock member such that, in operation, a protrusion on a work piece is accommodated by the channel.

2. The abrasive article of claim 1, wherein the abrasive layer comprises a lofty web of continuous three-dimensionally undulated inter-engaged autogenously bonded filaments.

3. The abrasive article of claim 1, wherein the non-threaded portion of the interlock member comprises a diameter smaller than a diameter of the threaded portion of the interlock member.

4. An abrasive article assembly comprising a disc-shaped nonwoven abrasive layer, an interlock member, and an attachment interface arranged between the abrasive layer and the interlock member securing the abrasive layer with the interlock member, wherein the attachment interface comprises a spin-weld interface; and wherein a channel extends along a central axis through the abrasive layer, the attachment interface, and the interlock member such that, in operation, a protrusion on a work piece is accommodated by the channel.

5. A method of forming an abrasive article, comprising the steps of:

providing nonwoven abrasive material;

providing a thermoplastic fastener;

movably contacting the nonwoven abrasive material and thermoplastic fastener;

maintaining moving contact between the nonwoven abrasive material under sufficient pressure to cause the nonwoven abrasive material and the thermoplastic fastener to become melt bonded together, and stopping the moving contact between the nonwoven abrasive material and the thermoplastic fastener;

wherein forming the abrasive article comprises aligning the abrasive layer and the thermoplastic fastener along a central axis such that a channel extends along the central axis through the abrasive layer and the thermoplastic fastener.

6. A method of forming an abrasive article as defined in claim 5, wherein the nonwoven abrasive material is provided in the form of a disc, and further wherein the abrasive material and thermoplastic fastener are movably contacted by rotating at least one of the abrasive material and the thermoplastic fastener.

* * * * *